US011332272B2

(12) United States Patent
Wang et al.

(10) Patent No.: US 11,332,272 B2
(45) Date of Patent: May 17, 2022

(54) GAS REMOVER AND ITS USE IN VACUUM PACKAGING OF AGRICULTURAL PRODUCTS

(71) Applicant: Fujian Institute of Subtropical Botany, Fujian (CN)

(72) Inventors: Wenhua Wang, Fujian (CN); Enming He, Fujian (CN); Qiyang Guan, Fujian (CN); Shoufu Cui, Fujian (CN); Liping Hong, Fujian (CN); Miao Tian, Fujian (CN); Ying Guo, Fujian (CN); Xiaoguang Hong, Fujian (CN)

(73) Assignee: Fujian Insitute of Subtropical Botany, Xiamen (CN)

( * ) Notice: Subject to any disclaimer, the term of this patent is extended or adjusted under 35 U.S.C. 154(b) by 126 days.

(21) Appl. No.: 16/805,741

(22) Filed: Feb. 29, 2020

(65) Prior Publication Data

US 2020/0290761 A1 Sep. 17, 2020

(30) Foreign Application Priority Data

Mar. 12, 2019 (CN) ..... 201910183806.1

(51) Int. Cl.
*B65B 31/02* (2006.01)
*B65B 31/04* (2006.01)

(52) U.S. Cl.
CPC ..... *B65B 31/024* (2013.01); *B65B 31/04* (2013.01)

(58) Field of Classification Search
None
See application file for complete search history.

(56) References Cited

U.S. PATENT DOCUMENTS

| | | | | | |
|---|---|---|---|---|---|
| 3,462,007 | A * | 8/1969 | Heider | B65D 81/09 | 428/72 |
| 2005/0053313 | A1* | 3/2005 | Lucas | B65B 61/16 | 383/16 |
| 2014/0133785 | A1* | 5/2014 | Diviesti | A61L 2/26 | 383/210.1 |
| 2014/0151260 | A1* | 6/2014 | Frank | B65D 31/16 | 206/524.5 |
| 2015/0004287 | A1* | 1/2015 | Crump | B65D 81/268 | 426/118 |
| 2015/0183531 | A1* | 7/2015 | Verhoest | B29B 7/603 | 141/1 |
| 2020/0315098 | A1* | 10/2020 | Poujaud | B65B 43/36 | |

FOREIGN PATENT DOCUMENTS

| | | | | |
|---|---|---|---|---|
| CN | 103039214 | A | 4/2013 | |
| CN | 106135817 | A | 11/2016 | |
| CN | 109552763 | A | 4/2019 | |
| WO | WO-2017216777 | A1 * | 12/2017 | B65B 25/02 |

* cited by examiner

*Primary Examiner* — Hemant Desai
*Assistant Examiner* — Tanzim Imam

(57) ABSTRACT

The present invention relates to the preservation and packaging of the agricultural products and discloses a gas remover and a method for packaging agricultural products. The gas remover provided herein is capable of effectively removing gas released in a vacuum sealer bag. The gas remover includes calcium hydroxide, which can effectively removes gas released by the plant-based agricultural products in the vacuum sealer bag, avoiding the expansion of the vacuum sealer bag.

2 Claims, 8 Drawing Sheets

GAS REMOVER AND ITS USE IN VACUUM PACKAGING OF AGRICULTURAL PRODUCTS

CROSS-REFERENCE TO RELATED APPLICATIONS

This application claims the benefit of priority from Chinese Patent Application No. 201910183806.1, filed on Mar. 12, 2019. The content of the aforementioned application, including any intervening amendments thereto, is incorporated herein by reference in its entirety.

TECHNICAL FIELD

The present application relates to the preservation and packaging of agricultural products, and more particularly to a gas remover and its use in the vacuum packaging of agricultural products.

BACKGROUND OF THE INVENTION

Plant-based agricultural products include primary products of various artificially and naturally grown plants and preliminarily processed products thereof. The plant-based agricultural products are widely produced and consumed, so the production and sales of the plant-based agricultural products greatly affect the national food security and economic development, in which the packaging of the plant-based agricultural products plays an important role. On the premise of ensuring the quality of the plant-based agricultural products, an adequate packaging method will play a significant role in facilitating the transportation, consumption and sales of the products and improving the market competitiveness of the products. Currently, vacuum packaging is commonly used to store the plant-based agricultural products, which can effectively maintain the quality and nutrient of products, inhibit the growth of aerobic bacteria and avoid the oxidative browning and squeezing deformation, thereby extending the storage and shelf life of products, reducing losses in the production and sales and promoting the processing chain of the plant-based agricultural products to achieve the object of safety, high quality and high efficiency.

However, gas may be generated in some vacuum-packaged plant-based agricultural products due to physiological activities, which causes the sealed bag to expand and the plant-based agricultural products to deteriorate, greatly limiting the application of the vacuum packaging in the processing of plant-based agricultural products and significantly affecting the sales of the products. Currently, since it is difficult to physically remove the gas released in a vacuum sealer bag, there is a need to develop a suitable chemical method to achieve the removal of the released gas.

Therefore, there is an urgent need to develop an effective and safe chemical method to remove gas released from the vacuum-packaged plant-based agricultural products.

SUMMARY OF THE INVENTION

An object of the invention is to provide a gas remover and the related method for vacuum-packaging agricultural products to overcome the defects in the prior art.

It should be noted that the invention is achieved based on the following findings.

It has been found through analysis that the gas released from the vacuum-packaged plant-based agricultural products is predominated by carbon dioxide and ethylene, and further includes trace amounts of ethanol and some volatile compounds of the products. The results show that the plant-based agricultural products still undergo vigorous anaerobic respiration in the closed oxygen-free environment formed by the vacuum packaging, and trace ethylene from the plant-based agricultural products promotes the continuation of the anaerobic respiration of the plant-based agricultural products, especially those with the characteristic of respiratory climacteric, resulting in the accumulation of anaerobic respiration products such as carbon dioxide and ethanol. High concentration of carbon dioxide in turn provokes stronger anaerobic respiration, resulting in deterioration of the plant-based agricultural products and expansion of the vacuum sealer bag. Therefore, it is required to develop a method for continuously removing carbon dioxide in the vacuum sealer bag to effectively regulate the anaerobic respiration of the plant-based agricultural products, keeping the packaging bag always in a tightly-sealed condition to ensure the quality of the plant-based agricultural products.

Carbon dioxide released in the vacuum sealer bag is hard to be removed through a physical method, so it is required to find a feasible chemical method to effectively remove the carbon dioxide. However, there are four obstacles in developing the chemical method, first, it is required to seek an effective chemical formulation for removing carbon dioxide in the vacuum sealer bag; second, it is required to determine whether the chemical formulation has toxicity and environmental damage and is suitable to be packaged together with the plant-based agricultural products; third, it is required to determine whether the chemical formulation can be still effective in the case that it is separated from the plant-based agricultural products; and fourth, the chemical formulation is required to have low cost to less affect the price of the plant-based agricultural products.

Given the above, the inventor has performed extensive experiments and finally selects calcium hydroxide from various gas-absorbing materials and reagents to be used as a core ingredient in the preparation of a gas remover, which has low cost and can effectively remove the gas generated in the vacuum sealer bag and avoid the expansion. The obtained gas remover not only does not affect the product quality, but also can extend the storage period and shelf life. Moreover, the gas remover is non-toxic and pollution-free, and complies with the standards for food additives.

The technical solutions of the invention are described as follows.

In a first aspect, the invention provides a gas remover for removing gas generated in a vacuum sealer bag, comprising calcium hydroxide.

In the gas remover, the calcium hydroxide can absorb carbon dioxide and form nontoxic calcium carbonate, which can effective remove the gas generated in the vacuum sealer bag and avoid the expansion, extending the storage period and shelf life of the products on the premise of ensuring the quality. In addition, the gas remover has low cost and is free of toxicity and environmental damages, and meets the standards for food additives.

In some embodiments, the gas remover further comprises aluminium oxide and water, where aluminium oxide is used to absorb trace gases, such as ethylene, and increase the air permeability of the gas remover; and water serves as a catalyst to accelerate the reaction between calcium hydroxide and carbon dioxide, and simultaneously provides necessary moisture conditions for the production of gas remover particles.

Further, the gas remover is prepared by a method comprising the following steps:

mixing calcium hydroxide, alumina and water to produce a mixture;

granulating the mixture by a granulator to obtain particles of the mixture; and packaging the particles of the mixture with wrapping paper to obtain the gas remover.

In some embodiments, the gas remover comprises 65-75% by weight of calcium hydroxide, 5% by weight of aluminium oxide and 20-30% by weight of water.

In some embodiments, the particles of the mixture have a columnar structure with a diameter of 3-5 mm and a height of 5-7 mm, or a spherical structure with a diameter of 3-5 mm.

In some embodiments, the wrapping paper is prepared from two layers of films by thermal sealing, and an inner layer of the wrapping paper is a composite plastic film with air pores and an outer layer of the wrapping paper is a permeable PE membrane. The two-layer design, of which the inner layer is provided with ventilation holes and the outer layer has breathability, can not only prevent the chemical ingredients such as calcium hydroxide from directly contacting with the plant-based agricultural products, but also ensure the gas remover to exert its function.

In a second aspect, the invention further provides a method for packaging agricultural products, comprising:

placing the agricultural products together with the gas remover in a vacuum bag for vacuum packaging to prolong the storage period and shelf life of the agricultural products.

Compared to the prior art, the invention has the following beneficial effects.

(1) The gas remover provided herein includes calcium hydroxide, which can effectively remove gas released by the plant-based agricultural products in the vacuum sealer bag, avoiding the expansion.

(2) The gas remover has low cost and can extend the shelf life of the plant-based agricultural products without affecting the quality.

(3) The gas remover provided herein is non-toxic and pollution-free, and complies with the standards for food additives.

DETAILED DESCRIPTION OF EMBODIMENTS

This invention will be further described in detail below with reference to the embodiments so that the technical solutions of the present invention are more understandable. It should be understood that these embodiments are not intended to limit the invention, but for the full and clear illustration of the present invention.

It should be noted that any changes, replacements and modifications made by those skilled in the art without departing from the spirit of the invention should fall within the scope of the invention. For example, the gas remover containing calcium hydroxide and other materials, or the gas remover formed by producing calcium hydroxide in the package through some other means also fall within the scope of the present invention. The gas remover may further used for the removal of gas generated in the vacuum packaging of other products in addition to agricultural products.

Example 1 Removal of Gas Produced by Vacuum-Packaged Garlic (1) Preparation of Gas Removers Calcium hydroxide, aluminium oxide and water were mixed to produce a mixture, where a mass ratio of the calcium hydroxide to aluminium oxide to water was 65:5:30. Then the mixture was granulated by a granulator to obtain columnar particles with a diameter of 4 mm and a height of 5 mm. The columnar particles were packaged with wrapping paper to prepare a 5 g gas remover and a 10 g gas remover, respectively, where the wrapping paper was prepared from two layers of films by thermal sealing, and an inner layer of the wrapping paper was a composite plastic film with air pores and an outer layer of the wrapping paper was a permeable PE membrane.

(2) Vacuum Packaging

Commercially available fresh garlic was peeled mechanically or manually. 100 g of the peeled garlic was placed together with the 5 g gas remover or the 10 g gas remover in a vacuum sealer bag and vacuum packaged. 100 g of the garlic free of the gas remover was vacuum packaged in a bag as a control. The three bags with the garlics were then observed under light at 25° C.

Figure 1:
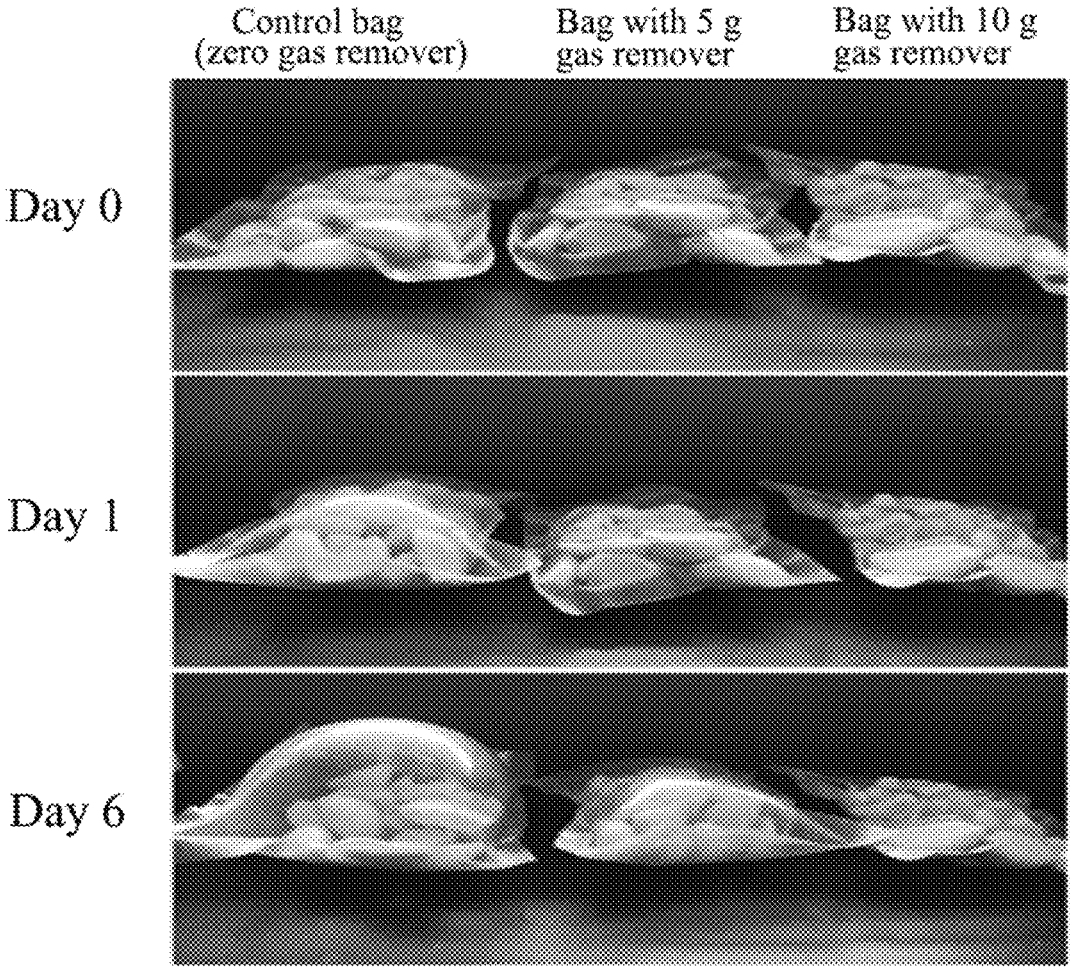
FIG. 1 shows the anti-expansion effect of a gas remover according to Example 1 on vacuum-packaged garlic.

As shown in FIG. 1, the expansion occurred in the control bag on day 1, in the bag with the 5 g gas remover on day 6 and in the bag with the 10 g gas remover on day 9. After 9 days, the garlic vacuum-packaged with the gas remover still had good quality, indicating that the gas remover did not affect the quality of the garlic in the vacuum sealer bag. Moreover, the garlic in the control bag was observed to begin to sprout and grow root on day 4, while the phenomenon of sprouting and root growing did not occur in the garlic vacuum-packaged with the gas remover. These results fully demonstrated that the gas remover provided herein could not only effectively avoid the expansion in the vacuum sealer bag, but also significantly extend the storage period and shelf life of the vacuum-packaged garlic.

Example 2 Removal of Gas Produced by Vacuum-Packaged Jackfruit Pulp (1) Preparation of Gas Removers Calcium hydroxide, aluminium oxide and water were mixed in a mass ratio of 75:5:20 to produce a mixture. Then the mixture was granulated by a granulator to obtain columnar particles with a diameter of 5 mm and a height of 7 mm. The columnar particles were packaged with wrapping paper to prepare a 10 g gas remover, where the wrapping paper was prepared from two layers of films by thermal sealing, and an inner layer of the wrapping paper was a composite plastic film with air pores and an outer layer of the wrapping paper was a permeable PE membrane.

(2) Vacuum Packaging

Commercially available fresh jackfruit was peeled manually to obtain jackfruit pulp containing seeds. 200 g of the jackfruit pulp was placed together with the 10 g gas remover in a vacuum sealer bag and vacuum packaged. 200 g of the jackfruit pulp free of the gas remover was vacuum packaged in a bag as a control. The two bags with the jackfruit pulps were observed under light at 25° C.

Figure 2:
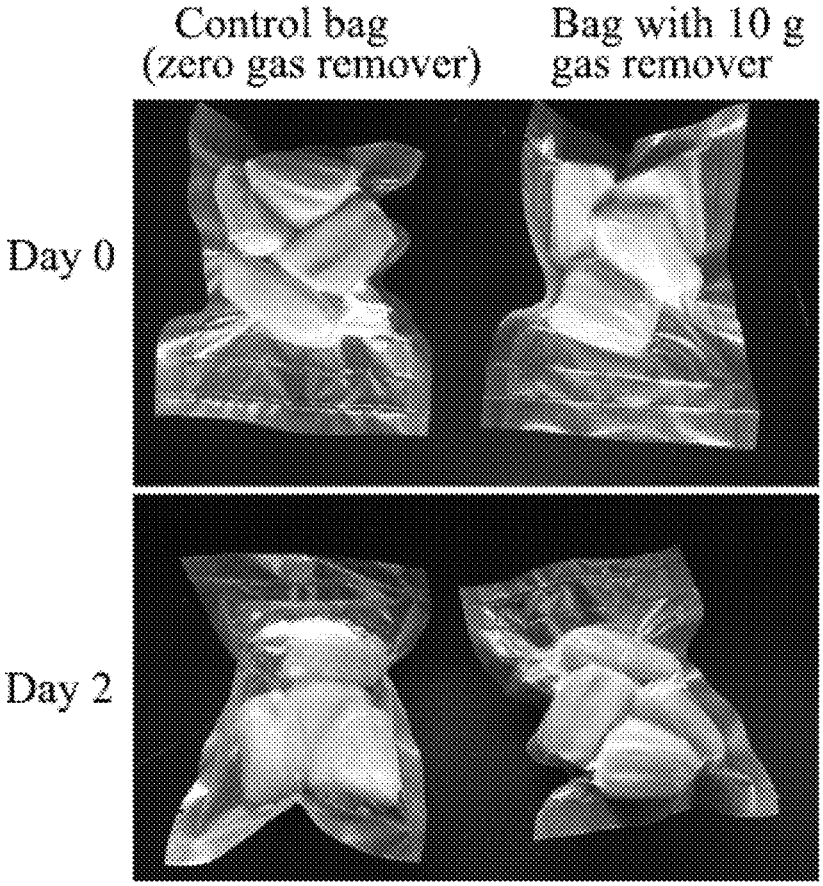
FIG. 2 shows the anti-expansion effect of a gas remover according to Example 2 on vacuum-packaged jackfruit pulp.

As shown in FIG. 2, the expansion occurred in the control bag on day 2 and in the bag with the 10 g gas remover on day 6, indicating that the gas remover can effectively remove gas generated from the vacuum-packaged jackfruit pulp to avoid the expansion. After 5 days, it was found that there were a large amount of mold on the surface of the jackfruit pulp in the control bag, while the jackfruit pulp vacuum-packaged with the gas remover still had good quality without microbial growth, indicating that the gas remover can significantly prolong the storage period and shelf life of the vacuum-packaged jackfruit pulp.

Example 3 Removal of Gas Produced by Vacuum-Packaged Kiwifruit (1) Preparation of Gas Removers Calcium hydroxide, aluminium oxide and water were mixed in a mass ratio of 65:5:30 to produce a mixture. Then the mixture was granulated by a granulator to obtain spherical particles with a diameter of 3 mm. The spherical particles were packaged with wrapping paper to prepare a 7 g gas remover, where the wrapping paper was prepared from two layers of films by thermal sealing, and an inner layer of the wrapping paper was a composite plastic film with air pores and an outer layer of the wrapping paper was a permeable PE membrane.

(2) Vacuum Packaging 150 g of commercially available fresh kiwifruit was obtained, placed together with the 7 g gas remover in a vacuum sealer bag and vacuum packaged. 150 g of the kiwifruit free of the gas remover was vacuum packaged in a bag as a control. The two bags with the kiwifruits were observed under light at 25° C.

Figure 3:
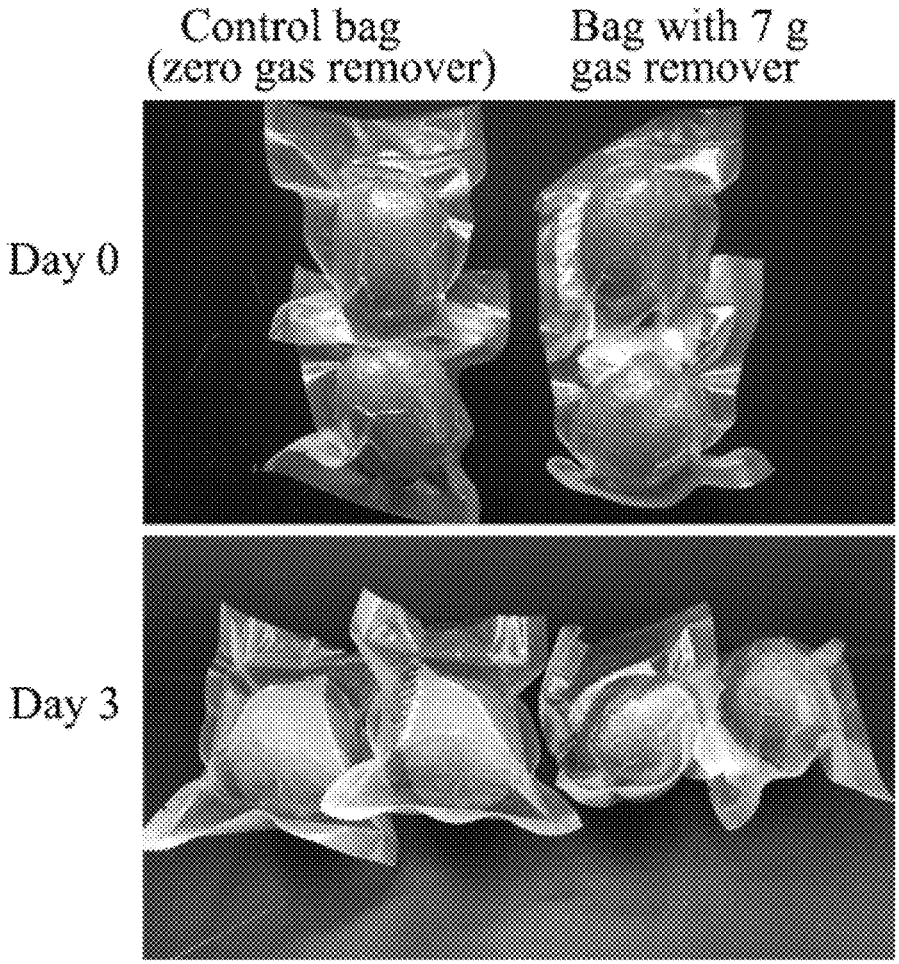
FIG. 3 shows the anti-expansion effect of a gas remover according to Example 3 on vacuum-packaged kiwifruit.

As shown in FIG. 3, the expansion occurred in the control bag on day 3 and in the bag with the 7 g gas remover on day 9, indicating that the gas remover can effectively remove gas generated from the vacuum-packaged kiwifruit to prevent the expansion in the vacuum sealer bag. After 9 days, the vacuum-packaged kiwifruit in the control bag was observed to suffer from significant reduction in the hardness and quality, while the kiwifruits in the bag with the 7 g gas remover still had good hardness and quality, indicating that the gas remover can significantly prolong the storage period and shelf life of the vacuum-packaged kiwifruits.

Example 4 Removal of Gas Produced by Vacuum-Packaged Kumquats and Longans (1) Preparation of Gas Removers Calcium hydroxide, aluminium oxide and water were mixed in a mass ratio of 70:5:25 to produce a mixture. Then the mixture was granulated by a granulator to obtain spherical particles with a diameter of 3 mm. The spherical particles were packaged with wrapping paper to prepare a 5 g gas remover, where the wrapping paper was prepared from two layers of films by thermal sealing, and an inner layer of the wrapping paper was a composite plastic film with air pores and an outer layer of the wrapping paper was a permeable PE membrane.

(2) Vacuum Packaging 120 g of commercially available fresh kumquats and 120 g of commercially available fresh longans were obtained, respectively placed together with the 5 g gas remover in a vacuum sealer bag and vacuum packaged. 120 g of kumquats free of the gas remover and 120 g of the longans free of the gas remover were respectively vacuum packaged in a bag as a control. The four bags were observed under light at 25° C.

Figure 4:
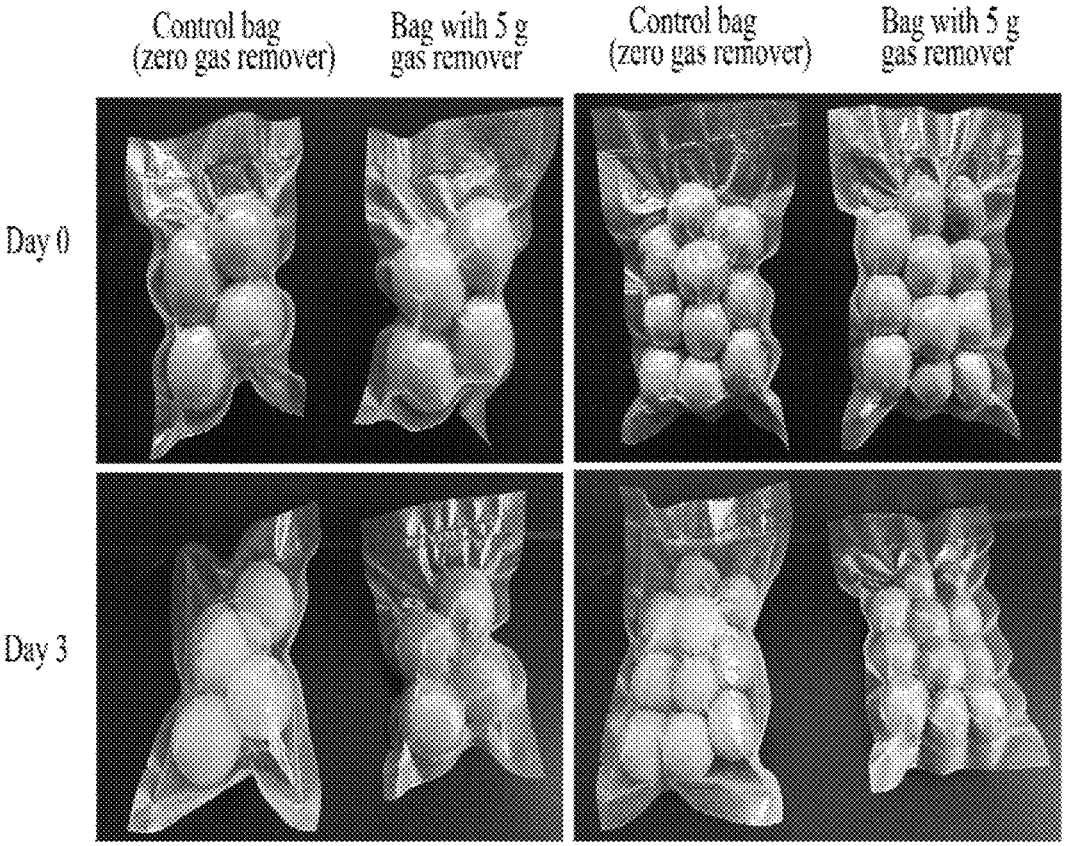
FIG. 4 shows the anti-expansion effect of a gas remover according to Example 4 on vacuum-packaged kumquat and longan.

As shown in FIG. 4, the expansion occurred in the two control bags on day 3 and in the two bags with the 5 g gas remover on day 7, indicating that the gas remover can effectively remove gas generated from the vacuum-packaged kumquats and longans to prevent the expansion in the vacuum sealer bag. After 7 days, the vacuum-packaged kumquats and longans in the two control bags were observed to suffer from a significant reduction in the quality, while the kumquats and longans vacuum-packaged with the gas remover still had good quality, indicating that the gas remover can significantly prolong the storage period and shelf life of the vacuum-packaged kumquats and longans.

Example 5 Removal of Gas Produced by Vacuum-Packaged Edamames (1) Preparation of Gas Removers Calcium hydroxide, aluminium oxide and water were mixed in a mass ratio of 65:5:30 to produce a mixture. Then the mixture was granulated by a granulator to obtain columnar particles with a diameter of 3 mm and a height of 6 mm. The columnar particles were packaged with wrapping paper to prepare a 10 g gas remover, where the wrapping paper was prepared from two layers of films by thermal sealing, and an inner layer of the wrapping paper was a composite plastic film with air pores and an outer layer of the wrapping paper was a permeable PE membrane.

(2) Vacuum Packaging 120 g of commercially available fresh edamames were placed together with the 10 g gas remover in a vacuum sealer bag and vacuum packaged. 120 g of the edamames free of the gas remover were vacuum packaged in a bag as a control. The two bags with the edamames were observed under light at 25° C.

Figure 5:
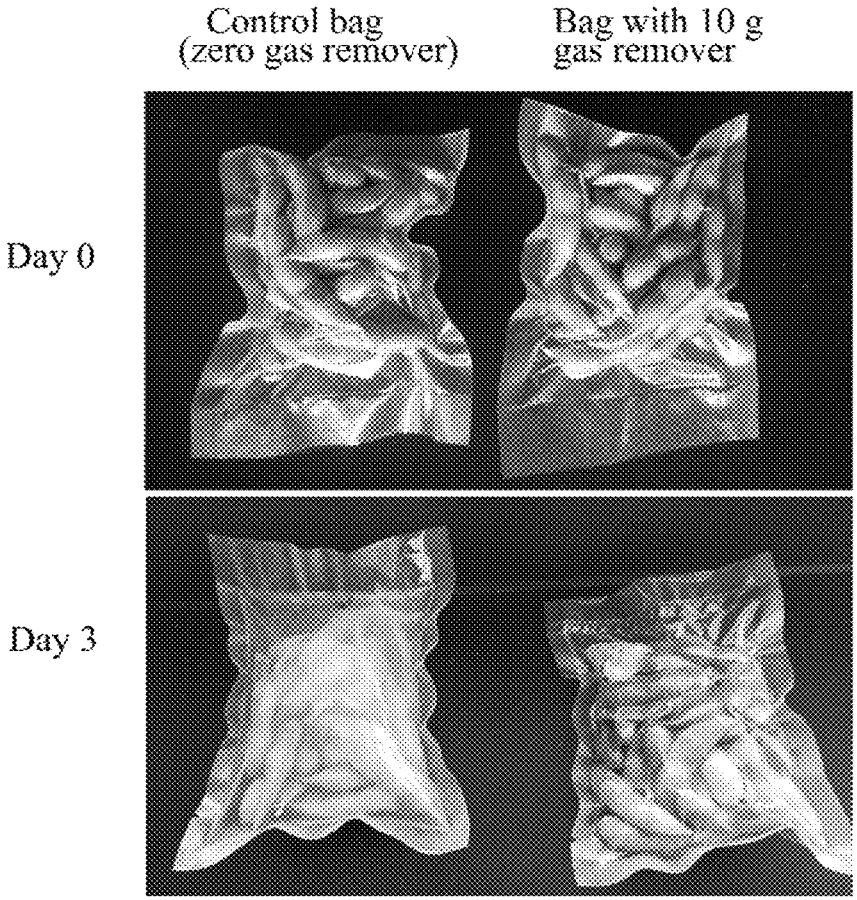
FIG. 5 shows the anti-expansion effect of a gas remover according to Example 5 on vacuum-packaged edamane.

As shown in FIG. 5, the expansion occurred in the control bag on day 3 and in the bag with the 10 g gas remover on day 8, indicating that the gas remover can effectively remove gas generated from the vacuum-packaged edamames to prevent the expansion in the vacuum sealer bag. After 8 days, the edamames in the two bags both were found to have good quality, indicating that the gas remover did not affect the quality of the edamames in the vacuum sealer bag.

Example 6 Removal of Gas Produced by Vacuum-Packaged Fresh Mushrooms (1) Preparation of Gas Removers Calcium hydroxide, aluminium oxide and water were mixed in a ratio of 75:5:20 to produce a mixture. Then the mixture was granulated by a granulator to obtain spherical particles with a diameter of 5 mm. The spherical particles were packaged with wrapping paper to prepare a 5 g gas remover, where the wrapping paper was prepared from two layers of films by thermal sealing, and an inner layer of the wrapping paper was a composite plastic film with air pores and an outer layer of the wrapping paper was a permeable PE membrane.

(2) Vacuum Packaging 65 g of commercially available fresh mushrooms were placed together with the 5 g gas remover in a vacuum sealer bag and vacuum-packaged. 65 g of the fresh mushrooms free of the gas remover were vacuum packaged in a bag as a control. The two bags were observed under light at 25° C.

Figure 6:
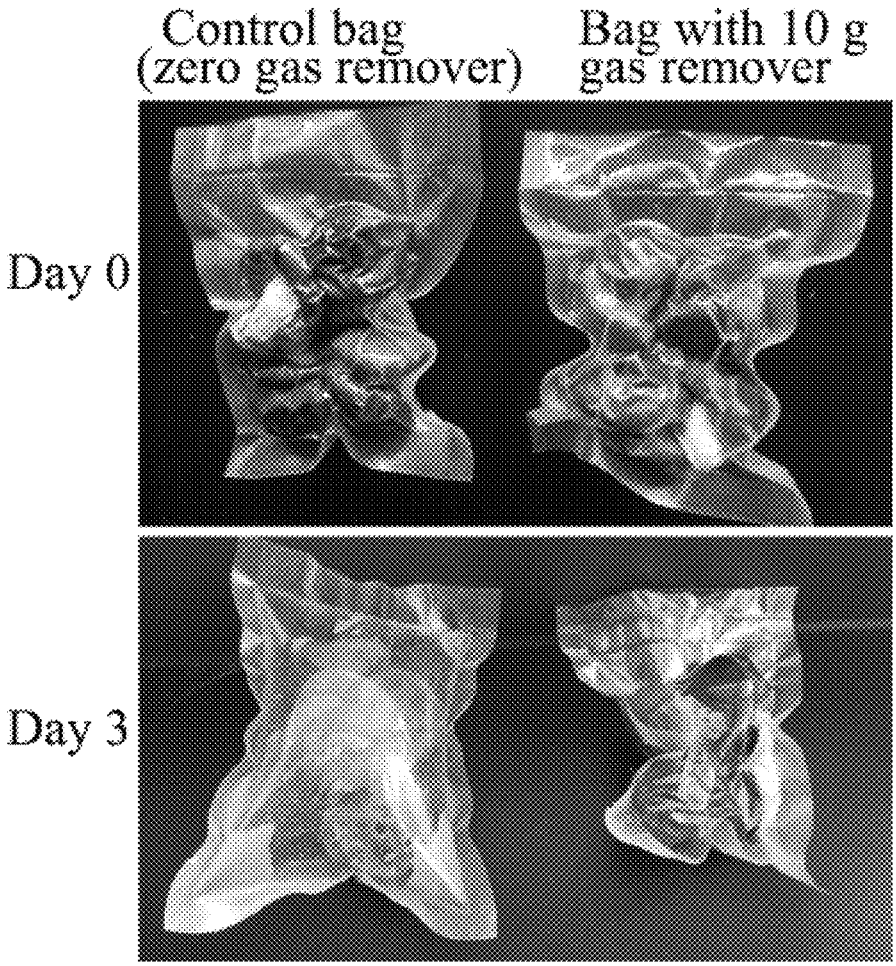
FIG. 6 shows the anti-expansion effect of a gas remover according to Example 6 on vacuum-packaged fresh mushroom.

As shown in FIG. 6, the expansion occurred in the control bag on day 3 and in the bag with the 5 g gas remover on day 7, indicating that the gas remover can effectively remove gas generated from the vacuum-packaged fresh mushrooms to prevent the expansion in the vacuum sealer bag. After 7 days, the fresh mushrooms in the two bags were both found to have good quality, indicating that the gas remover did not affect the quality of the fresh mushrooms in the vacuum sealer bag.

Example 7 Removal of Gas Produced by Vacuum-Packaged Seaweed Knots in a Sealed Bag (1) Preparation of a Gas Remover Calcium hydroxide, aluminium oxide and water were mixed in a mass ratio of 75:5:20 to produce a mixture. Then the mixture was granulated by a granulator to obtain columnar particles with a diameter of 5 mm and a height of 7 mm. The columnar particles were packaged with wrapping paper to prepare a 10 g gas remover, where the wrapping paper was prepared from two layers of films by thermal sealing, and an inner layer of the wrapping paper was a composite plastic film with air pores and an outer layer of the wrapping paper was a permeable PE membrane.

(2) Vacuum Packaging 100 g of commercially available fresh seaweed knots were placed together with the 10 g gas remover in a vacuum sealer bag and vacuum-packaged. 100 g of the seaweed knots free of the gas remover were vacuum packaged in a bag as a control. The two bags were observed under light at 25° C.

Figure 7:
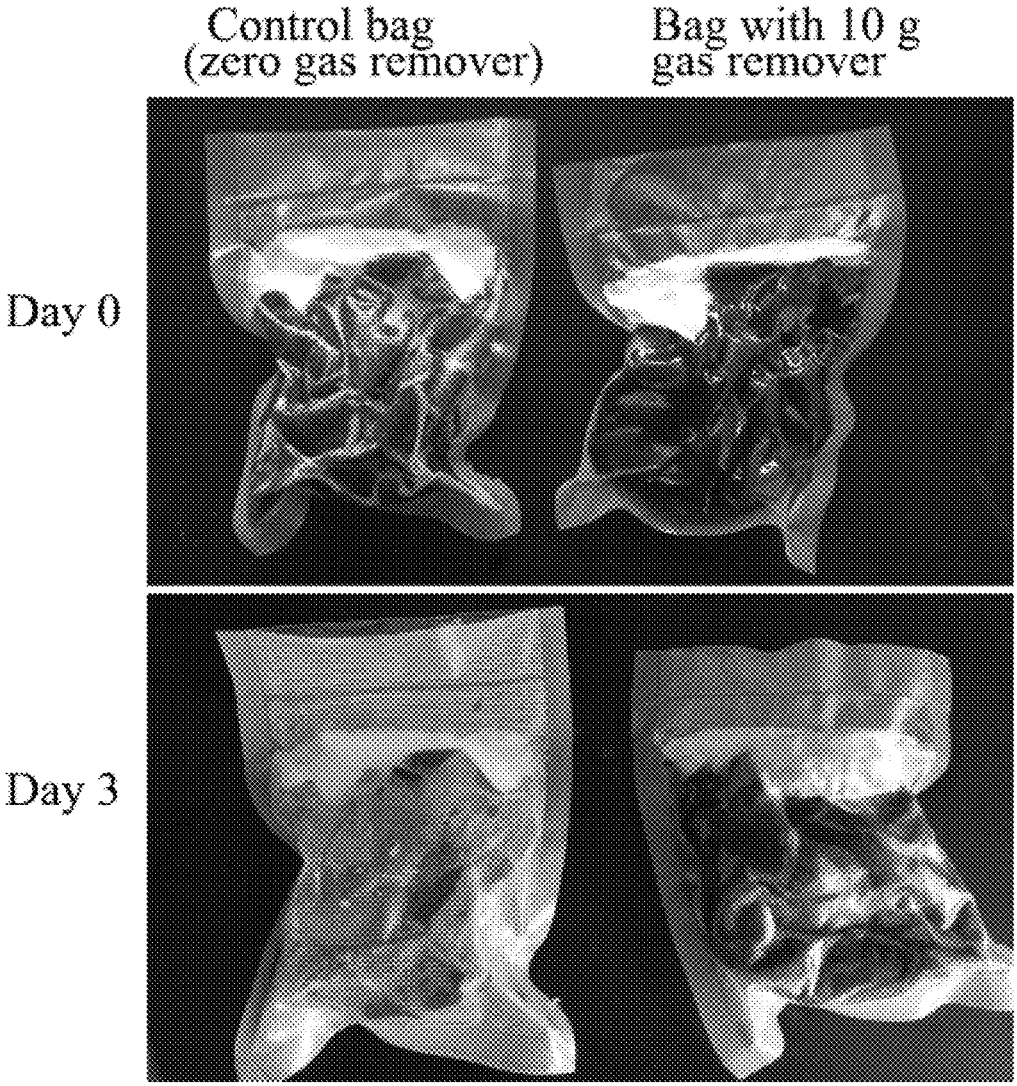
FIG. 7 shows the anti-expansion effect of a gas remover according to Example 7 on vacuum-packaged seaweed knot.

As shown in FIG. 7, the expansion occurred in the control bag on day 3 an in the bag with the 10 g group on day 6, indicating that the gas remover can effectively remove gas generated from the vacuum-packaged seaweed knots to prevent the expansion in the vacuum sealer bag. After 5 days, the vacuum-packaged seaweed knots in the control bag were found to suffer from significant reduction in quality, such as dehydration and decay, while the seaweed knots vacuum-packaged with the gas remover still had good quality on day 10, indicating that the gas remover can significantly prolong the storage period and shelf life of the seaweed knots in the vacuum sealer bag.

Example 8 Removal of Gas Produced by Vacuum-Packaged Durian Pulp (1) Preparation of gas removers Calcium hydroxide, aluminium oxide and water were mixed in a mass ratio of 75:5:20 to produce a mixture. Then the mixture was granulated by a granulator to obtain columnar particles with a diameter of 5 mm and a height of 7 mm. The columnar particles were packaged with wrapping paper to prepare a 10 g gas remover, where the wrapping paper was prepared from two layers of films by thermal sealing, and an inner layer of the wrapping paper was a composite plastic film with air pores and an outer layer of the wrapping paper was a permeable PE membrane.

(2) Vacuum Packaging

Commercially available fresh durian was peeled manually to obtain durian pulp containing seeds. 80 g of the durian pulp together with the 10 g gas remover was placed in a vacuum sealer bag and vacuum packaged. 80 g of the durian pulp free of the gas remover was vacuum packaged in a bag as a control. The two bags were observed under light at 25° C.

Figure 8:
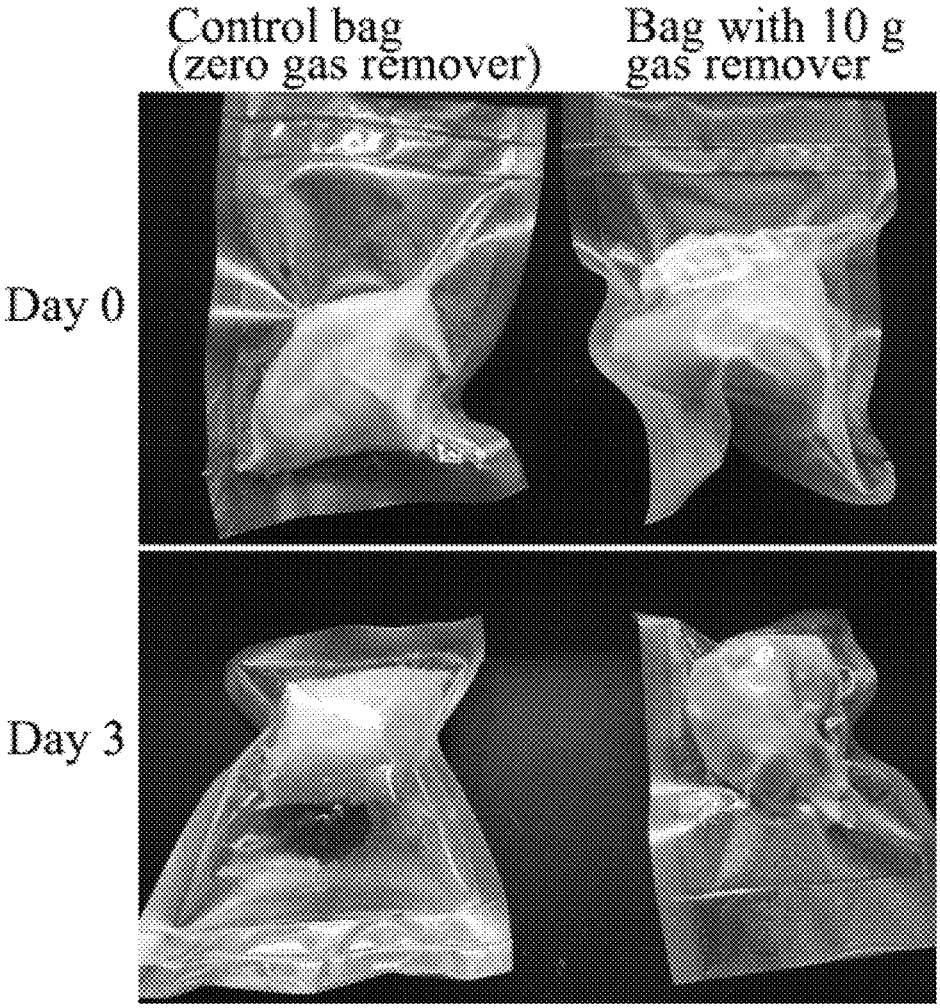
FIG. 8 shows the anti-expansion effect of a gas remover according to Example 8 on vacuum-packaged durian pulp.

As shown in FIG. 8, the expansion occurred in the control bag on day 3 and in the bag with the 10 g gas remover on day 8, indicating that the gas remover can effectively remove gas generated from the vacuum-packaged durian pulp to prevent the expansion in the vacuum sealer bag. After 8 days, the durian pulps in the two bags were both found to have good quality, indicating that the gas remover did not affect the quality of the durian pulp in the vacuum sealer bag.

In summary, the gas remover provided herein can effectively remove gas generated from the vacuum-packaged plant-based agricultural products to avoid the expansion in the vacuum sealer bag, extending the storage period and shelf life of the plant-based agricultural products. Moreover, the gas remover has low cost, and is free of toxicity and environmental pollution and complies with the standards for food additives.

As used herein, terms "an embodiment", "embodiments", "an example", "specific examples" and "examples" all refer to at least one embodiment or example including specific features, structures and materials of the invention. These terms are illustrative and are not limited to the same embodiment. The specific features, structures, materials or features of the invention disclosed herein can be combined in any suitable manner in one or more embodiments or examples. In addition, those skilled in the art can obtain other embodiments by combining the embodiments or examples disclosed herein.

It should be understood that the embodiments described above are illustrative of the invention and are not intended to limit the invention. Any changes, modifications, transformations and replacements made by those skilled in the art without departing from the spirit of the invention shall fall within the scope of the invention.

What is claimed is:

1. A gas remover for removing gas produced by kiwifruit vacuum-packaged in a vacuum sealer bag, the gas remover consisting of: 65% by weight of calcium hydroxide, 5% by weight of aluminum oxide, and 30% by weight of water;

wherein the gas remover is obtained by: mixing the calcium hydroxide, the aluminum oxide, and the water to produce a mixture, granulating the mixture by a granulator to obtain particles of the mixture, and packaging the particles of the mixture with wrapping paper to obtain the gas remover;

wherein the particles of the mixture have a spherical structure with a diameter of 3 mm; and wherein the wrapping paper is prepared from two layers of film by thermal sealing, the two layers of film consisting of an inner layer and an outer layer, the inner layer being a composite plastic film with air pores and not being in contact with kiwifruit, and the outer layer being a gas permeable polyethylene (PE) membrane and not being in contact with the mixture.

2. A method for packaging kiwifruit, the method comprising:

placing the kiwifruit together with the gas remover of claim 1 in a vacuum sealer bag for vacuum packaging.

* * * * *